US006019711A

United States Patent [19]

Koenig

[11] Patent Number: 6,019,711

[45] Date of Patent: Feb. 1, 2000

[54] LEG EXTENSION EXERCISER

[75] Inventor: Larry Koenig, Williamsburg, Iowa

[73] Assignee: Jam'n Fitness Corp., Williamsburg, Iowa

[21] Appl. No.: 09/073,980

[22] Filed: May 7, 1998

[51] Int. Cl.[7] ..... A63B 21/06; A63B 23/04

[52] U.S. Cl. ..... 482/97; 482/137

[58] Field of Search ..... 482/94, 97, 98, 482/100, 112, 130, 136, 137

[56] References Cited

U.S. PATENT DOCUMENTS 2,855,199 10/1958 Noland et al. ..... 982/97

5,683,334 11/1997 Webber ..... 482/100

*Primary Examiner*—John Mulcahy

*Attorney, Agent, or Firm*—Allan L. Harms

[57] ABSTRACT

Exercise apparatus for building strength in the lower extremities while reducing the risk of injury to knee joints. A weight-bearing lever is pivotable upon a first post located forward and to the side of a seat for the user. A second pivotable arm which has a cushioned leg bar mounted to it is pivotable about a second pivot point on the first post. A roller bearing extends from the pivotable arm and is received by a bearing race fixed to the underside of the weight-bearing lever. As the user moves the leg bar forward and upward, the roller urges the weight-bearing lever upward. The Rolling Fulcrum™ pivot support of the weight-bearing lever moves away from the user reducing the moment arm of the weight on the weight-bearing arm as the user's legs approach full extension at the knee.

10 Claims, 3 Drawing Sheets

LEG EXTENSION EXERCISER

BACKGROUND OF THE INVENTION

In the realm of body exercise and strength training, there is a need to strengthen the muscles of the thigh which are used to extend the leg at the knee. In order to build strength in the leg extension muscles, it is essential to increase the resistive load on the muscles as the user's strength level increases. It is also desirable to reduce the risk of injury and to increase range of motion as the exercise is performed.

Various exercise devices have been devised to exercise the thigh muscles as the legs are extended at the knee. These devices function by allowing the user, while seated, to rest the shins or ankles behind a weighted bar and then to force the bar forward in an upward arc as the legs are extended. Some of these devices cause the effective resistance to maximize as the knee reaches full extension when it is most vulnerable to injury. Other leg extension exercisers work on similar principles but with complicated lever arrangements without satisfactorily reducing the resistance on the leg as the leg is extended at the knee.

SUMMARY OF THE INVENTION

It is an object of the present invention to provide an exercise apparatus which permits a user to build leg strength while reducing the risk of injury to knee structures. This is accomplished by a load weight decrease as the knee joint comes into full extension. This changing resistance during the execution of this exercise is accomplished by the use of Negative Variable Resistance™ loading. Negative Variable Resistance™ loading means that as the concentric contraction of the muscles of the thigh is performed, the effective weight is decreasing. This principle encourages full range of motion without generating excessive momentum and joint shear to the knees.

The invention includes a generally rectangular frame upon which is mounted a slightly reclining seat for the user. A pivot supporting post is disposed slightly forward of and to the side of the user. A weight-bearing lever is pivotally mounted to the top of the post and extends away from the user. At rest, the weight-bearing lever rests on a support post standing upright from the frame and spaced away from the user. A bearing race is fixed longitudinally along the lower side of the weight-bearing lever near its pivot mount on the pivot supporting post. A weight-mounting rod is fixed to the weight-bearing lever a distance from the pivot mount of the weight-bearing lever. The weight-mounting rod is essentially horizontal and perpendicular to the weight-bearing lever and sized to receive typical circular Olympic weight plates. Increase in the resistive load is accomplished by placing additional Olympic weight plates on the weight-mounting rod.

A pivoting arm is suspended from the pivot support post but its pivot on the pivot support post is offset from the pivot of the weigh-bearing lever such that the pivoting arm is spaced laterally further from the user than the pivot of the weight-bearing lever. The pivoting arm is provided with a roller bearing which extends perpendicularly from the pivoting arm and is received in the bearing race mounted to the weight-bearing lever. A transverse leg engagement bar extends perpendicularly from the pivoting arm such that when the apparatus is at rest, the leg engagement bar is disposed slightly forward of and below the seat such that the front of the user's lower legs or ankles can be positioned behind the leg engagement bar. As the user extends the legs at the knee, the pivoting arm pivots upward and away from the user and in doing so, the roller in the bearing race causes the weight-bearing lever to rotate upward about its pivot mount.

The effective length of the pivoting arm is adjustable through use of a telescoping inner box tube selectively positioned by pin means. As the weight-bearing lever is forced upward by the roller attached to the pivoting arm, the effective fulcrum of the weight-bearing lever moves away from the user and reduces the moment arm of the weight-bearing lever applied to the user's legs as the leg is extended. This reduces stress on the user's knee components and increases the range of motion. This is the benefit of Negative Variable Resistance™ loading. This machine is able to accomplish this by using dual offset pivoting levers and a Rolling Fulcrum™ pivot support that diverges away from the pivot support post. This divergent Rolling Fulcrum™ pivot support pushes up and toward the weight load, thereby varying the load. The use of the Rolling Fulcrum™ pivot support is a critical concept to these machines and how they effect variable resistance and smooth, dependable usage.

It is also an object of the invention to provide leg extension exercise apparatus which is simple in construction and maintenance. Another objective of the invention is to provide a leg exercise apparatus which permits use of existing barbell weight plates for loading. Another objective of the invention is to provide a leg apparatus which facilitates addition and removal of weights at a relatively low height. It is a further objective of the invention to provide leg-strengthening apparatus which is safe and stable in use.

These and other objectives will be understood from a review of the detailed description below.

DESCRIPTION OF THE DRAWING FIGURES

DETAILED DESCRIPTION OF THE INVENTION

Figure 1:
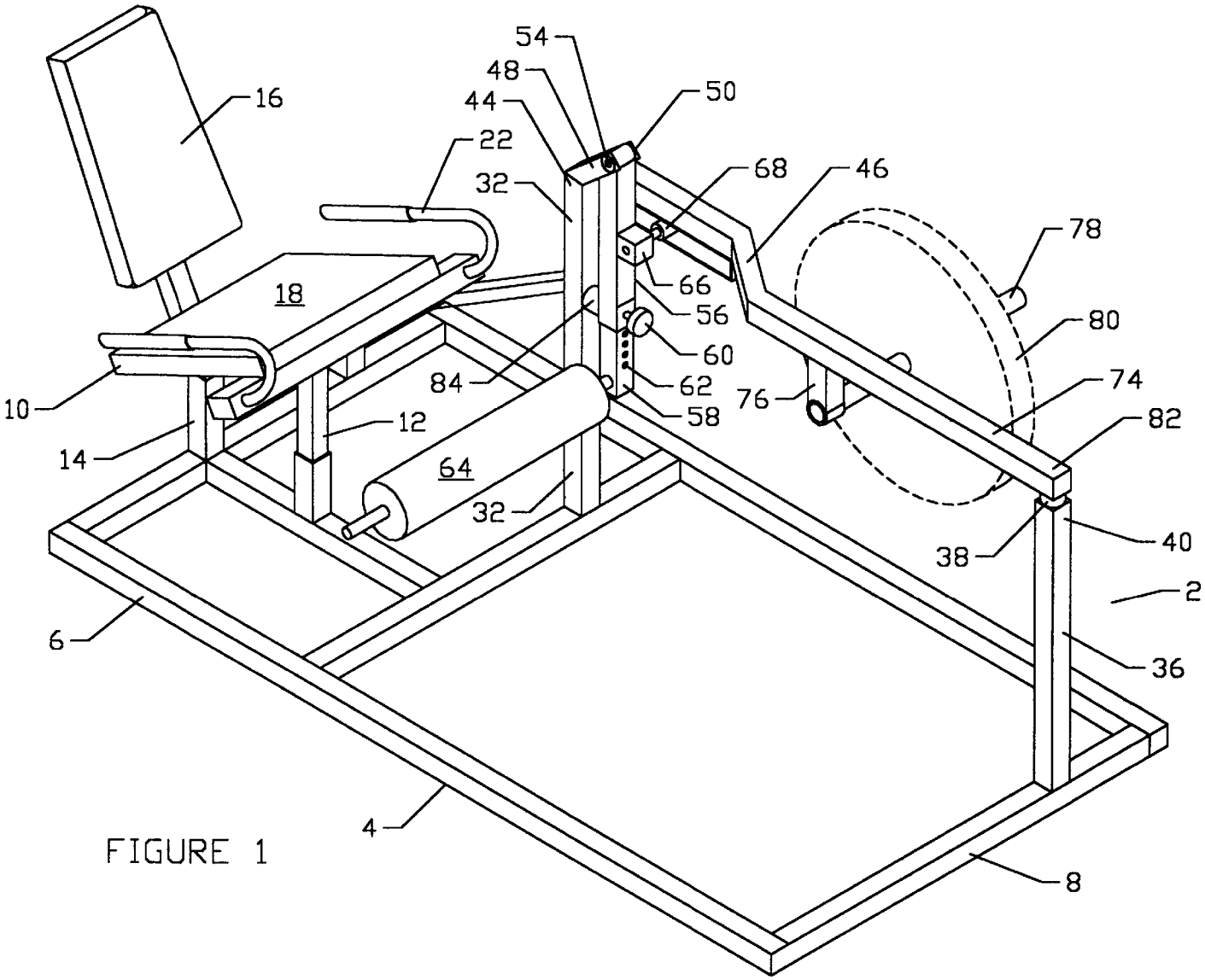
FIG. 1 is a front right perspective of the preferred embodiment of the invention at rest with a barbell weight shown in phantom mounted on the weight bar of the invention.
Figure 2:
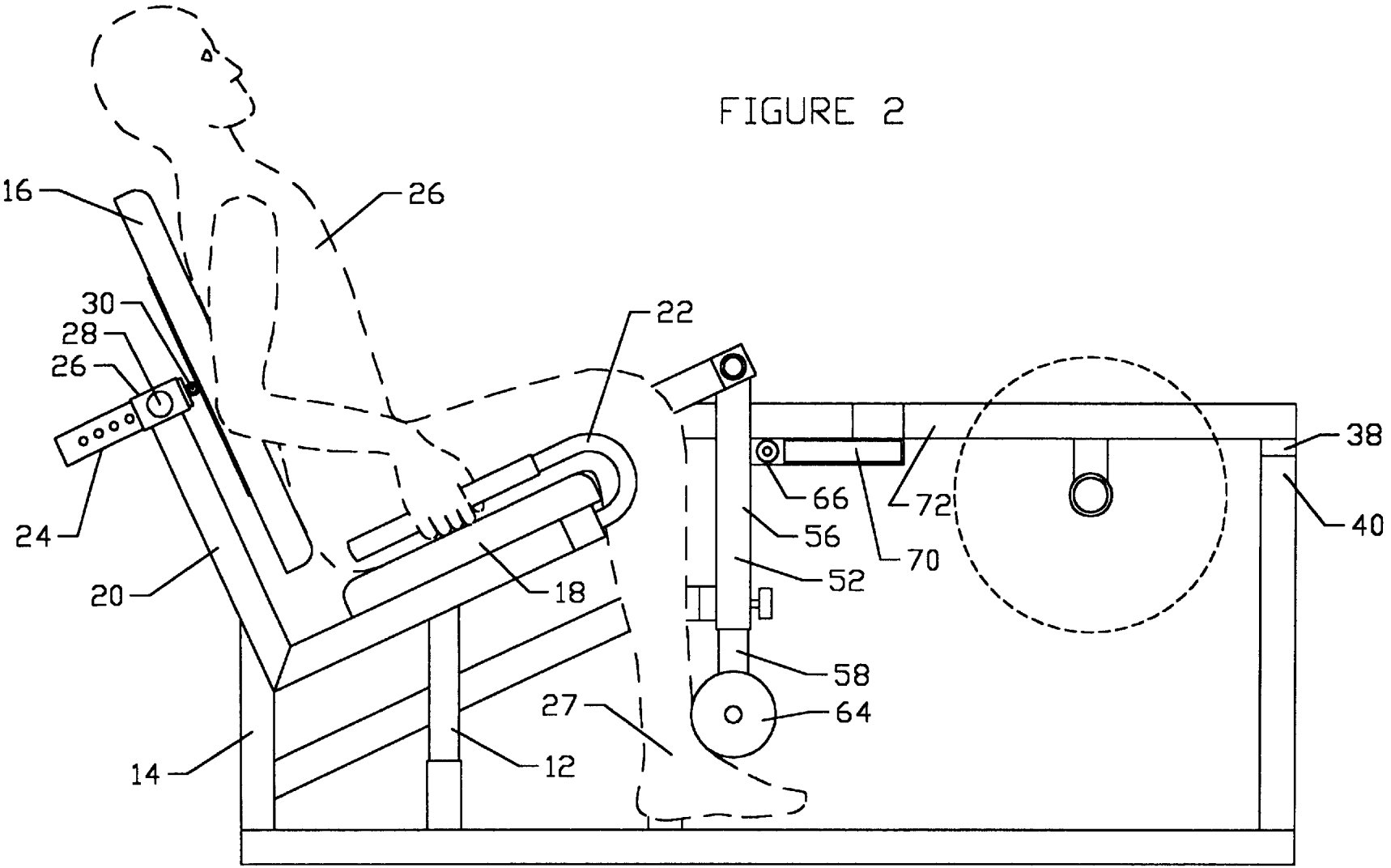
FIG. 2 is a front elevation of the invention with a user and a barbell weight plate shown in phantom.
Figure 3:
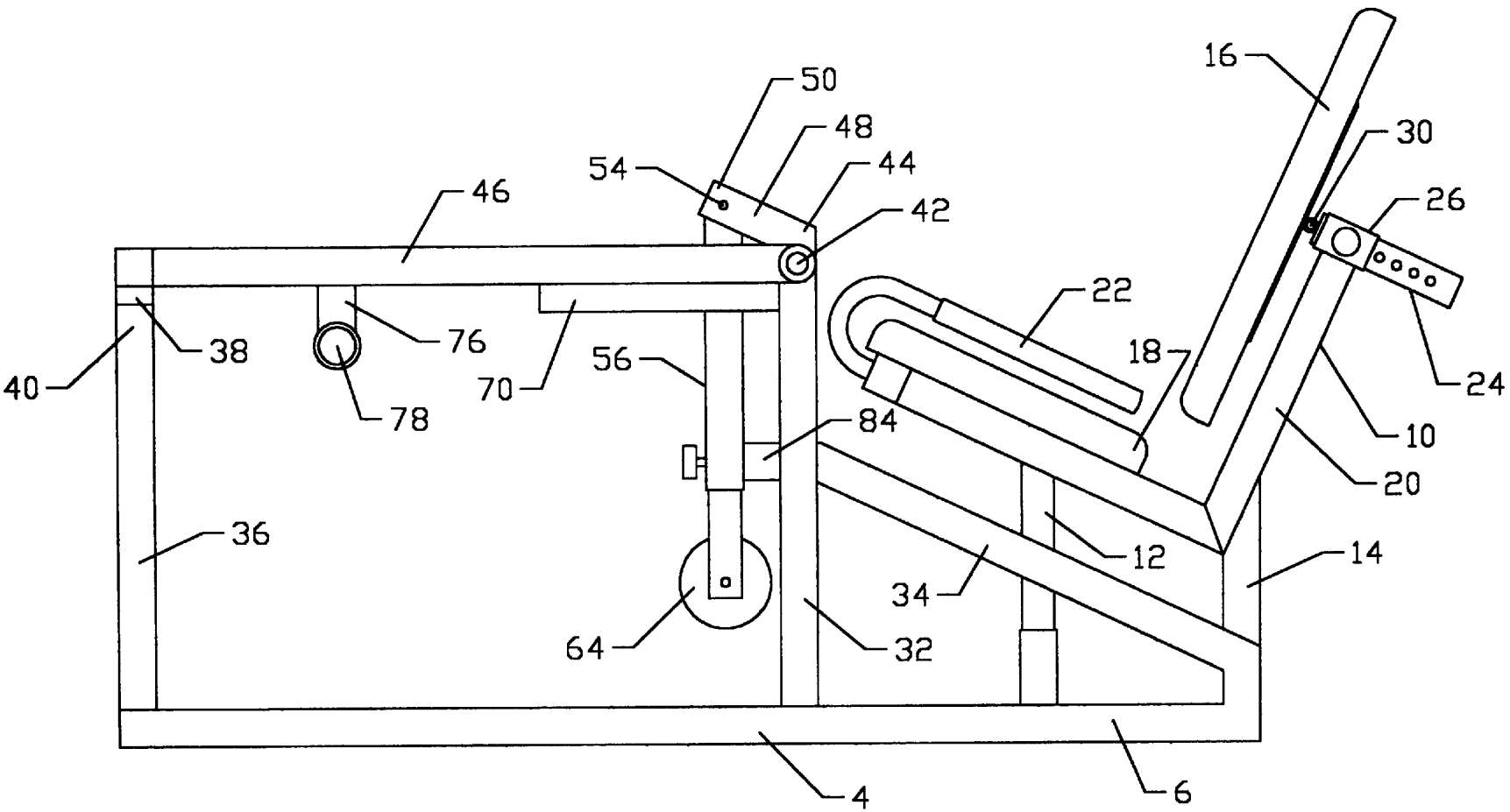
FIG. 3 is a rear elevation of the invention.

Referring to the drawings, the invention 2 is shown having base 4 which is generally rectangular with a user support end 6 and an opposing second end 8. A seat 10 is supported over user support end 6 of base 4 by center leg 12 and rear leg 14. Seat 10 is provided with back cushion 16 and seat cushion 18 which are supported on seat frame 20 which mounts to center leg 12 and rear leg 14. Curved handles 22 are mounted to seat frame 20 on opposing sides of seat cushion 18 to provide grips for a user 26 seated on seat 10. Seat 10 is positioned to recline rearwardly and is provided with adjustment means to adjust the position of back cushion 16 upon seat frame 20, the adjustment means of the preferred embodiment being a shaft 24 slideable within guide 26 and selectively positioned by plunger 28. Seat cushion 16 is retained to shaft 24 by a pin 30 thereby allowing seat cushion to rock over a range to conform to the body of the user.

A first upright post 32 is disposed midway along base 4 such that first upright post is positioned slightly forward and to the side of seat frame 20. Brace 34 interconnects first upright post 32 to base 4 to stabilize first upright post 32.

A second upright post 36 is mounted at second end 8 of base 4. Second upright post 36 is provided with a flexible bumper 38 at its upper end 40. First upright post 32 provides a pivot mount 42 near its upper end 44 for weight-bearing lever 46. Weight-bearing lever 46 is pivotable upward from its rest on bumper 38 within a vertical plane which is generally parallel to the vertical centerline of back cushion 16.

To reduce torsional forces on pivot mount 42 of weight-bearing lever 46, weight-bearing lever 46 is bent to offset distal segment 74 of weight-bearing lever 46 toward the center of base 4 such that barbell plate 80 generally aligns in a common plane with first upright post 32. Mounted along distal segment 74 of weight-bearing lever 46 is weight arm 76 which mounts weight bar 78 to weight-bearing lever 46. Weight bar 78 is disposed substantially horizontally and is preferably a rod properly sized such that typical Olympic circular weight plates such as barbell weight 80 may be easily placed on weight arm 78. The distal end 82 of weight-bearing lever 46 rests on bumper 38 of second upright post 36 when the apparatus is at rest.

Angled extension 48 of first upright post 32 extends upwardly and toward second end 8 from upper end 44 of first upright post 32. Distal end 50 of angled extension 48 is forked to provide means for cylindrical pin 54 to suspend pivotable arm 56 from distal end 50. Pivotable arm 56 is thereby pivotal about cylindrical pin 54 upon distal end 50. Pivotable arm 56 may comprise an upper section 52 telescopingly slideable upon lower section 58 in order that a desired length of pivotable arm 56 may be selected by use of spring-loaded plunger 60 which is operative with holes 62 of second section 58. Pivotable arm 56 is moveable within a substantially vertical plane which is parallel to the plane in which weight-bearing lever 46 is moveable.

The length of pivotable arm 56 is variable according to the length of the legs of the user 26. A cushioned leg engagement bar 64 is perpendicularly mounted to pivotable arm 56 near its lower end and is provided for the user 26 to push with the fronts of the user's ankles 27.

Mounted midway along pivotable arm 56 and aligned vertically below weight-bearing lever 46 is roller mounting member 66 which positions the axis of roller 68 perpendicularly to pivotable arm 56. Roller 68 is received by bearing race 70 which longitudinally extends along and is mounted to the underside 72 of weight-bearing lever 46.

A resilient damper 84 is disposed upon first upright post 32 to cushion touching engagement between leg engagement support arm 56 and first upright post 32 when force by the user ceases to be exerted against leg engagement bar 64.

OPERATION OF THE INVENTION

The user may select the proper length of leg engagement support arm 56 by selective placement of plunger 60 in holes 62 and may adjust placement of back cushion 16 to a comfortable setting by location of shaft 24 in guide 26. The user may then sit on seat cushion 18 and place the ankles 27 of one or both legs behind leg engagement bar 64. As the user then extends the legs at the knees, the pivotal movement of pivotable arm 56 about its pivot, cylindrical pin 54, causes roller 68 to apply upward force against underside 72 of weight-bearing lever 46 causing it to lift barbell weight 80. As weight-bearing lever 46 rotates upward about pivot mount 42, roller 68 moves away from the user along bearing race 70. As the roller 68 moves further away from the user, the moment arm between the roller 68 and pivot mount 42 increases and thereby improves the leverage of the user in pushing against leg engagement bar 64. The exercise apparatus thereby applies Negative Variable Resistance™ loading to the user as the user's legs at the knees approach extension, thereby reducing the load on the legs as the knees reach a relatively more vulnerable position.

Having described the invention, I claim:

1. Leg exercise apparatus comprising a base having a seat supported over the base, a first support member mounted to said base, a weight-bearing lever pivotally mounted to said first support member at a pivot mount, said pivot mount disposed above said base, the weight-bearing lever having means to selectively affix weights thereto along the length thereof, an elongate arm suspended from said support member by a hinge, said hinge disposed above said base and spaced apart laterally and vertically from said pivot mount, said elongate arm having means to touchingly engage the legs of a user seated on said seat, said elongate arm having a roller mounted thereto, said weight-bearing lever having a bearing race longitudinally mounted thereto, said roller received in said race and moveable therealong, said roller urging said weight-bearing lever upward as said elongate arm is urged away from said seat.

2. The leg exercise apparatus of claim 1 wherein a second support member is mounted to said base laterally displaced from said seat and said first support member, said second support member generally vertically disposed at the height of said pivot mount of said weight-bearing lever, said weight-bearing lever resting on said second support member when said elongate arm is at rest.

3. The leg exercise apparatus of claim 1 wherein said weight-bearing lever pivotable within a vertical plane, said elongate arm pivotable within a vertical plane generally parallel to said plane of movement of said weight-bearing lever.

4. The leg exercise apparatus of claim 3 wherein said apparatus having a rest position, said weight-bearing lever disposed generally horizontally when said apparatus is at rest, said elongate arm disposed generally vertically when said apparatus is at rest.

5. The leg exercise apparatus of claim 4 wherein said plane of movement of said elongate arm is displaced laterally from said plane of movement of said weight-bearing lever.

6. The leg exercise apparatus of claim 3 wherein said first support member is an upstanding post mounted to said base, said pivot mount of said weight-bearing member spaced to the side of and slightly forward of said seat, said hinge of said elongate arm disposed above and forward of said pivot mount of said weight-bearing member.

7. The leg exercise apparatus of claim 6 wherein said upstanding post has a linear segment and an angled extension, said linear segment having an upper end, said angled extension extending from the upper end of said linear segment, said pivot mount fixed to said upper end of said linear segment, said hinge fixed to said angled extension.

8. The leg exercise apparatus of claim 7 wherein said apparatus having a rest position, said weight-bearing lever disposed generally horizontally when said apparatus is at rest, said elongate arm disposed generally vertically when said apparatus is at rest.

9. The leg exercise apparatus of claim 7 wherein a second support member is mounted to said base laterally displaced from said seat and said first support member, said second support member generally vertically disposed at the height of said pivot mount of said weight-bearing lever, said weight-bearing lever resting on said second support member when said elongate arm is at rest.

10. In a leg exercise apparatus having a seat mounted upon a base and having a weight-bearing lever pivotally mounted to a support member at a pivot point disposed above said base and laterally forward of said seat and further having means to selectively mount weight plates to the weight-bearing lever, the improvement comprising an elongate arm having a first end and a free end, said first end of said elongate arm pivotally mounted to said support member at a hinge point laterally and vertically displaced from said pivot point of said weight-bearing lever, said weight-bearing lever having an underside, a bearing member mounted to said elongate arm along the length thereof, said bearing member touchingly engaging said underside of said weight-bearing lever and moveable in touching engagement therealong, said elongate arm having means for a user seated on said seat to pivotally displace said elongate arm about said hinge by use of a user's legs.

* * * * *